United States Patent [19]

Belinsky

[11] 4,331,097

[45] May 25, 1982

[54] FLOATING DOLPHIN

[76] Inventor: Sidney I. Belinsky, 40 Waterside Plaza, Apt. 29M, New York, N.Y. 10010

[21] Appl. No.: 902,508

[22] Filed: Jun. 2, 1978

[51] Int. Cl.[3] ..... B63B 21/00

[52] U.S. Cl. ..... 114/230; 114/219

[58] Field of Search ..... 9/8 P; 114/230, 219; 405/202, 212

[56] References Cited

U.S. PATENT DOCUMENTS

| | | | |
|---|---|---|---|
| 3,464,213 | 9/1969 | Stephenson | 405/212 |
| 3,690,108 | 9/1972 | Tam | 405/202 X |
| 3,722,223 | 3/1973 | Gratz | 9/8 P X |
| 3,798,916 | 3/1974 | Schwemmer | 114/219 X |

*Primary Examiner*—Trygve M. Blix
*Assistant Examiner*—Jesus D. Sotelo

[57] ABSTRACT

A floating breasting dolphin for a ship's berth which absorbs the ship's impact energy by being pivoted and lifted from the surface of the water. The dolphin consists of a floating pontoon, which is connected through universal joints to anchors on the bottom of the sea by two transverse and inclined levers and one longitudinally inclined lever. A fender is supported on the front part of the pontoon by a universal joint. The anchor system thereby distributes the impact forces from the ship to the sea bottom. The system allows the dolphin to sink to the bottom of the sea in heavy storms or under ice conditions and refloat as conditions improve.

3 Claims, 6 Drawing Figures

FLOATING DOLPHIN

The present invention relates to berths for large ships such as tankers and the like and, in particular, to breasting dolphins which absorb the energy of the ship's impact being permitted to radically alter its position to that end.

The principal object of this invention is to increase the energy absorption of berthing ships against dolphins and to reduce the cost and time needed to construct such dolphins.

The main novelty of this invention is in utilizing the entire breasting dolphin of the berth as a gravity mass for absorbing the impact of a berthing ship and in providing a combination of mechanical devices for lifting the main part of the breasting dolphin relatively high off the water. Most importantly, the system includes levers which are uniquely arranged to insure that the contact point between the berthing ship and the pontoon's fender at one end is fixed in position while the opposite end of the pontoon is being lifted. The ability of lift a big mass in this manner markedly increases the energy absorption of the dolphin during the berthing procedure. The ability to maintain the contact point between the berthing ship and the dolphin in fixed position during the period the floating pontoon is being lifted from the water protects the ship's side from damage.

The present breasting dolphin has the capability of sinking to the bottom of the sea in heavy storms or under ice conditions and refloat as conditions improve.

Other objects and advantages of the invention may be appreciated on reading the following description of one embodiment thereof which is taken together with the accompanying drawings, in which.

Figure 1:
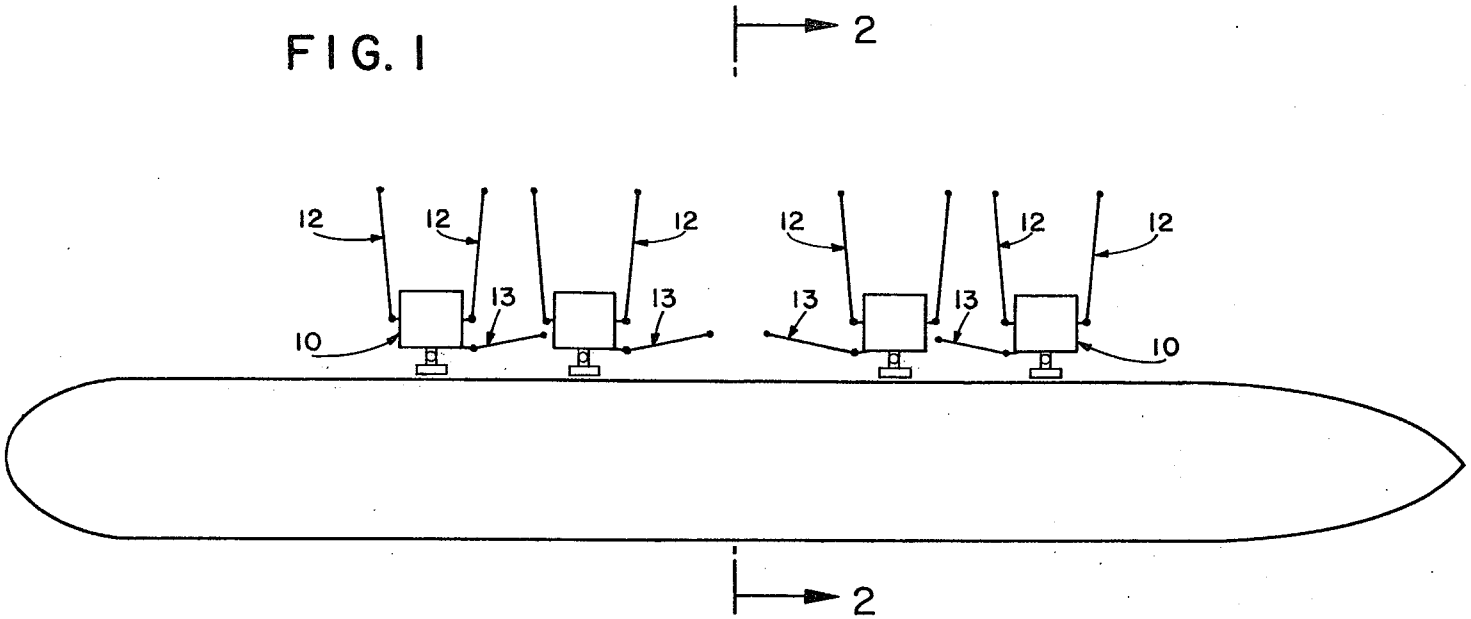
FIG. 1 is a plan view of the berth with four breasting dolphins and a ship alongside them.
Figure 2:
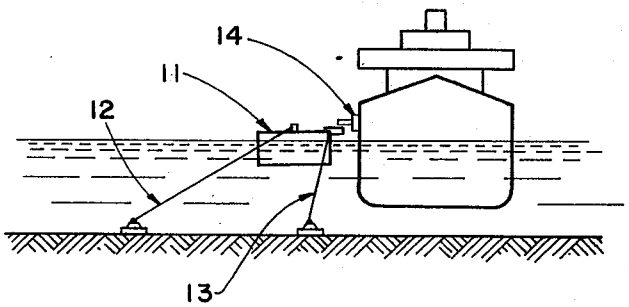
FIG. 2 is a section taken on the line A—A in FIG. 1.

Referring to the drawings, breasting dolphin 10 has as its principal component pontoon 11. Transverse and normally inclined levers 12 are connected by universal joints 16, located above the pontoon's deck, to the respective sides of the pontoon 11 midway between its front and rear ends permitting the pontoon to be pivoted on the joints 16 when the pontoon is contacted by a berthing ship. Longitudinal lever 13, which is also normally inclined, is connected by universal joint 16 to one side edge of the pontoon at its front end. Fender 14 is connected by universal joint 15 to the front edge of the pontoon.

Figure 3:
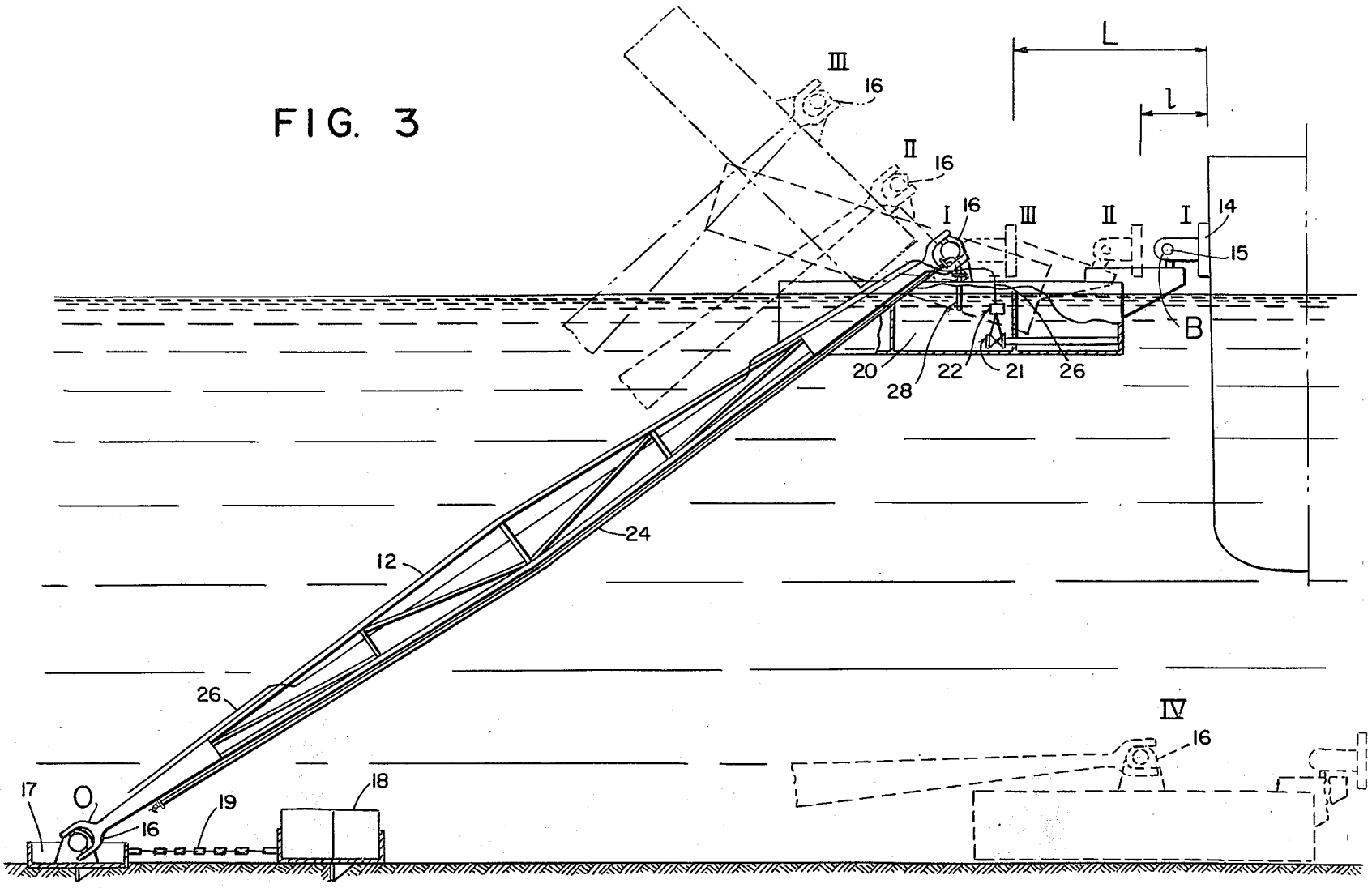
FIG. 3 is an enlarged section taken on line A—A of FIG. 1 showing the various rotated positions of the dolphin as a berthing ship moves horizontally against it and its single position on the sea bottom.

As shown in FIG. 3 the levers are connected by universal joint 16 secured to anchor plates 17 which in turn are connected to a concrete block 18 by chain 19.

The pontoon is provided with a floodable compartment 20, the water passing through valve 21 controlled by drive 22.

Figure 4:
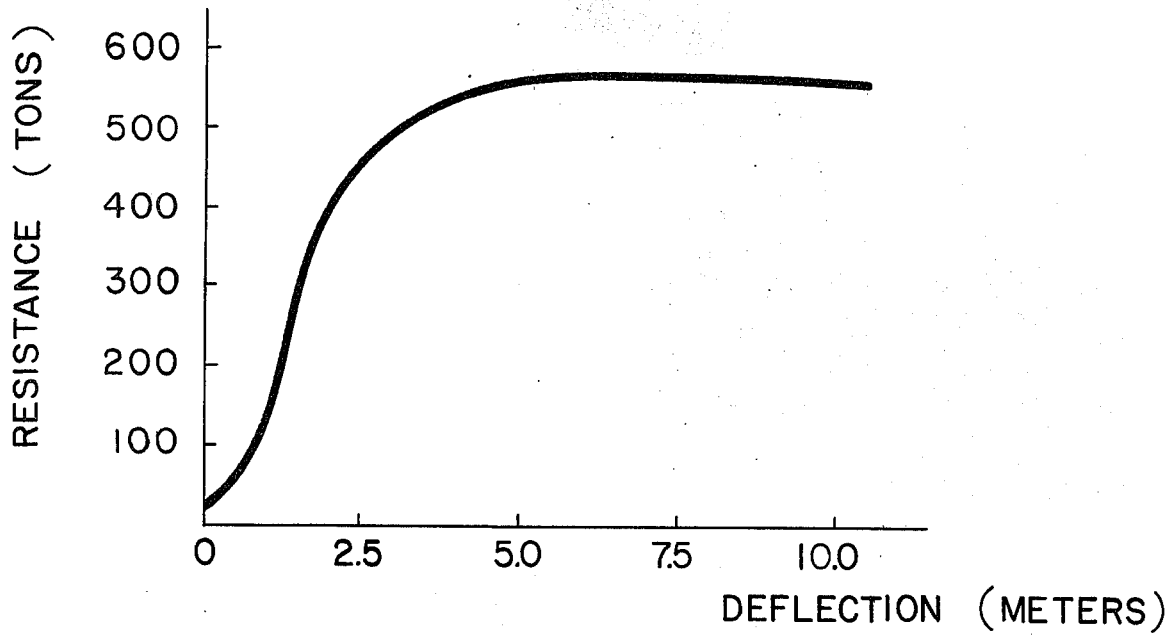
FIG. 4 is a graph showing resistance force acting on the ship versus deflection of the breasting dolphin.
Figure 5:
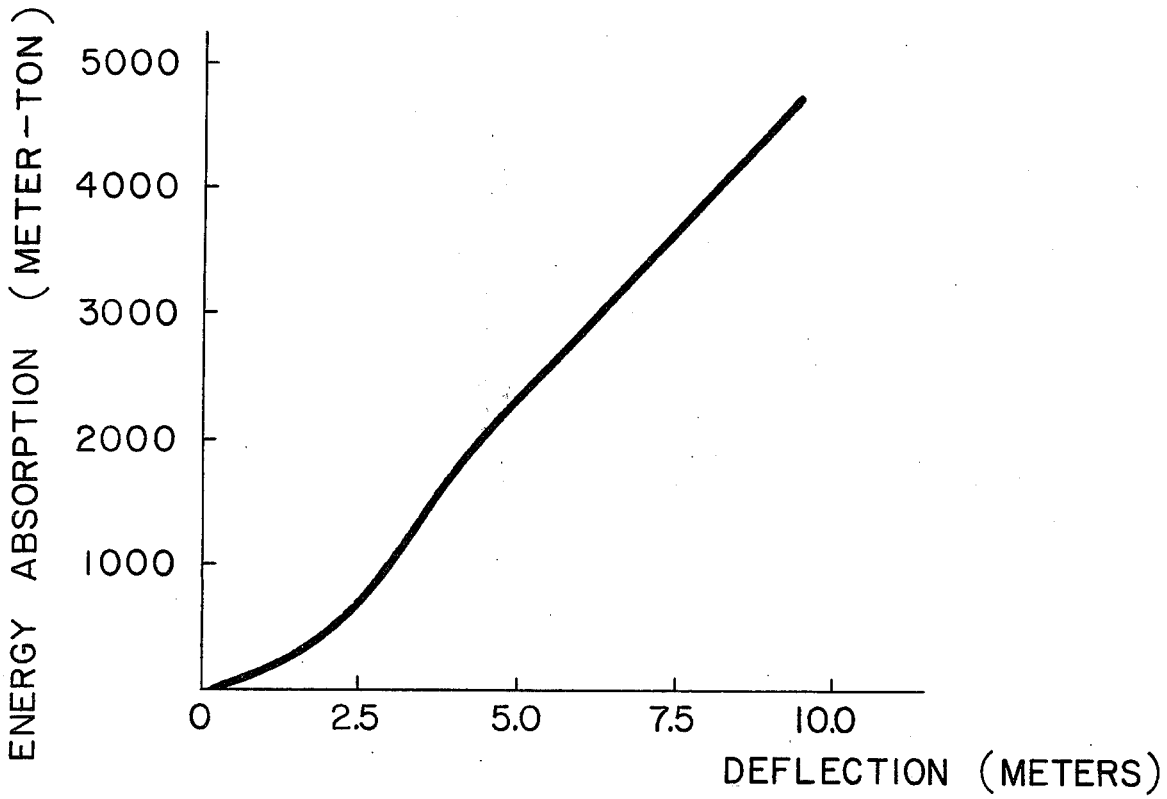
FIG. 5 is a graph showing energy absorption of the breasting dolphin versus its deflection.
Figure 6:
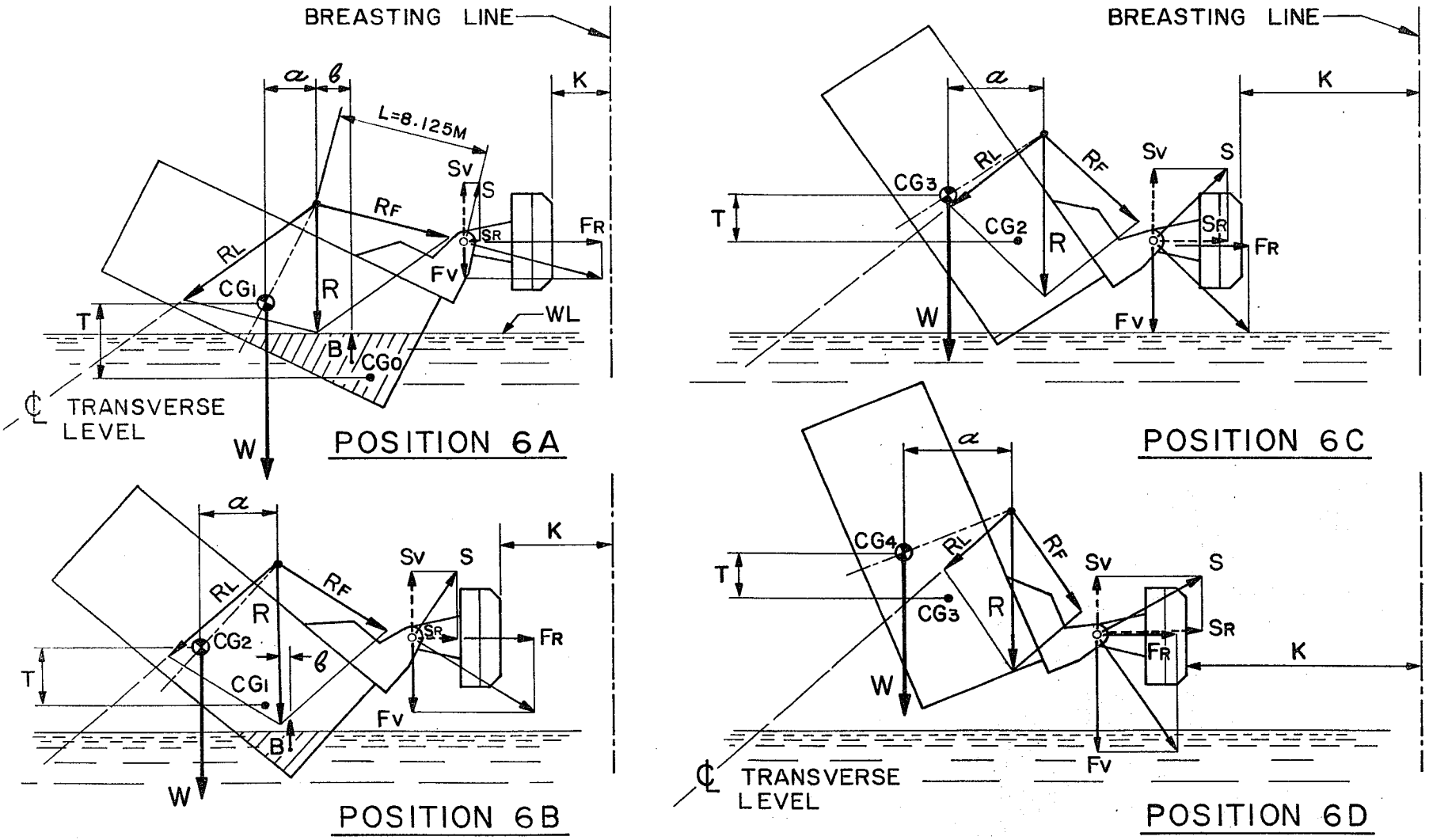
FIGS. 6A–6D show a scheme of forces acting on the breasting dolphin in four positions.

FIG. 4 shows that resistance force of the breasting dolphin rises rapidly during first quarter of dolphin's deflection and it is practically constant on the last ¾ of its deflection. This is achieved due to location the universal joint 16 above the pontoon's center of gravity. When pontoon 11 rotates, thus creating restoring moment $M_1$, as shown in FIGS. 6A–6D, which causes an additional horizontal force ($S_h$) component resisting the ship.

Computation table shows that when pontoon 11 is deflected from 25% to the maximum allowable, the increasing horizontal force $S_h$ compensates for the decreasing force $F_h$ and keeps the total horizontal force $\Sigma H$ practically constant.

When the ship is in docking position with reference to said dolphin 10, a breasting line is defined, which line is an imaginary line at sea level drawn tangent to the ship's side and parallel to its longitudinal axis.

Position I

This is a normal position when the ship is near the berth and is approaching to make contact with fender 14.

Position II

This is an intermediate position when the ship moves the fender 14 a distance 1. Because of the friction between fender 14 and the ship's hull the pivot point B moves with the ship's hull without changing its contact position thereon. This movement through universal joint 16 on the pontoon 11 starts to rotate the levers 12 around their pivotal point. As a result of these two motions pontoon 11 comes to position II which is shown by broken line. In this position the front end of the pontoon is still in the water.

Position III

This is the extreme position of the raised dolphin being shown by phantom lines. In this position the pontoon is fully lifted out from the water.

Usually the berthing ship contacts fender 14 at an angle and therefore the impact force is distributed partly in the perpendicular direction and partly in the longitudinal direction.

The force exerted in the transverse direction by the berthing ship pivots the inclined levers 12 and lifts up the pontoon. The force in the longitudinal direction is taken up by the longitudinal lever 13 which does considerably less shifting than the inclined levers 12 because the longitudinally inclined lever 13 is connected to the pontoon near the fender and therefore is only slightly affected by the trajectory of pontoon movement on the levers 12. All levers are connected to the pontoon by means of universal joints with three axes of rotation; therefore, the forces acting on the levers will create only tension and compression stresses thereon.

Position IV

This is a position where the pontoon has sunk to the bottom of the sea. In position I by a distance governed by drive 22, valve 21 is opened and the surrounding water flows into floodable compartment 20 and therefore the pontoon is sunk to the bottom. To return the pontoon to its normal position I the water from compartment 20 will be pumped out by compressed air and the valve 21 is then closed.

Various modifications of the invention can be effected by persons skilled in the art without departing from the principle and scope thereof as defined in the appended claims.

COMPUTATION TABLE
of energy absorption and main forces in floating breasting dolphin

| | | Unit | Designation | Position I | Position IV | Position II | Position III |
|---|---|---|---|---|---|---|---|
| 1 | Total Weight | ton | W | 565 | 565 | 565 | 565 |
| 2 | Buoyancy | ton | B | 148 | 15 | 0 | 0 |
| 3 | R = W − B - acting force | ton | R | 417 | 550 | 565 | 565 |
| 4 | a - restoring arm | meter | a | 2.75 | 3.75 | 4.75 | 5.50 |
| 5 | $M_1$ = Wxa - restoring moment | tm | $M_1$ | 1553 | 2118 | 2683 | 3107 |
| 6 | b - buoyancy arm | m | b | 1.50 | 0.37 | 0 | 0 |
| 7 | $M_2$ = Bxb - buoyancy moment | tm | $M_2$ | 222 | 5.6 | 0 | 0 |
| 8 | $M_A = M_1 - M_2$ - acting restoring moment | tm | $M_A$ | 1331 | 2113 | 2683 | 3107 |
| 9 | Force acting along the levers 12 | ton | $R_L$ | 531 | 484 | 390 | 312 |
| 10 | | ton | $R_F$ | 437 | 453 | 453 | 437 |
| 11 | | ton | $F_h$ | 422 | 390 | 328 | 234 |
| 12 | | ton | $F_v$ | 117 | 234 | 312 | 360 |
| 13 | $S = M_A : L$ L = 8.125 m - force created by acting restoring moment | ton | S | 160 | 265 | 329 | 380 |
| 14 | | ton | $S_v$ | −156 | −203 | −234 | −218 |
| 15 | | ton | $S_h$ | 55 | 140 | 234 | 297 |
| 16 | $\Sigma V = F_v - S_v$ | ton | $\Sigma V$ | −39 | 31 | 78 | 140 |
| 17 | $\Sigma H = F_h + S_h$ − total force resisting ship | ton | $\Sigma H$ | 476 | 531 | 562 | 531 |
| 18 | The lift of center gravity from previous position | m | T | 4.00 | 2.75 | 2.62 | 2.37 |
| 19 | Energy absorption $E = \frac{W - B}{2} \times T$ | tm | E | 834 | | | |
| 20 | $E = \left(R + \frac{W - R}{2}\right) \times T$ | tm | E | | 1350 | | |
| 21 | $E = W \times T$ | tm | E | | | 1480 | 1340 |
| 22 | Deflection of dolphin | m | K | 2.5 | 5.0 | 7.5 | 10.0 |

Total energy absorption
$\Sigma E = 834 + 1350 + 1480 + 1340 = 5004$ tm

What is claimed is:

1. A floating breasting dolphin of a berth, capable of absorbing impact from a berthing ship by transferring the ship's kinetic energy into potential energy through lifting of a floating part of the dolphin from the water, comprising a floating pontoon, a fender supported at the front end of said pontoon and adapted to engage the berthing ship, a fender's universal joint connecting the back of said fender with the front end of said floating pontoon, a pair of levers normally inclined to the sea bottom and transversely oriented to the breasting line of the berth connected at their lower ends to separate underwater foundation by means of universal joints and at their upper ends by universal joints, respectively, to the sides of said pontoon at points located between the front and rear ends and above the upper deck of said pontoon thereof at a substantial distance from the universal joint of said fender and substantially above the pontoon's center of gravity whereby the distance between said points and said fender's universal joint constitute the radius of rotation for said pontoon around said fender's universal joint as the ship moves the fender which is staying fixedly in place on the ship's side by force of friction, a longitudinal lever also normally inclined to the sea bottom but parallel to the front end of said pontoon and the breasting line of the berth being connected at its lower end to separate underwater foundation by a universal joint and at its upper end by a universal joint to one side of said pontoon proximate the universal joint of said fender.

2. A floating breasting dolphin as defined in claim 1 wherein said fender is connected to the middle of the front end of said pontoon, said transverse levers are connected to the middle of the sides of said pontoon, and the universal joints connecting said fender, said transverse and longitudinal levers to said pontoon are located at the same height above the upper deck of said pontoon.

3. A floating breasting dolphin as defined in claim 1 wherein said pontoon is formed from a rectangular box and includes a compartment having valve means for receiving surrounding water causing the sinking thereof and air compression means for pumping out said water to effect the raising of said pontoon.

* * * * *